US011110414B2

(12) United States Patent
Goshima

(10) Patent No.: US 11,110,414 B2
(45) Date of Patent: Sep. 7, 2021

(54) BUBBLE GENERATION DEVICE, TUBULAR MEMBER, BUBBLE GENERATION METHOD, AND METHOD FOR MANUFACTURING BUBBLE GENERATION DEVICE

(71) Applicant: Kagoshima University, Kagoshima (JP)

(72) Inventor: Takashi Goshima, Kagoshima (JP)

(73) Assignee: Kagoshima University, Kagoshima (JP)

( * ) Notice: Subject to any disclaimer, the term of this patent is extended or adjusted under 35 U.S.C. 154(b) by 329 days.

(21) Appl. No.: 16/320,458

(22) PCT Filed: Jul. 21, 2017

(86) PCT No.: PCT/JP2017/026463
§ 371 (c)(1),
(2) Date: Jan. 24, 2019

(87) PCT Pub. No.: WO2018/021182
PCT Pub. Date: Feb. 1, 2018

(65) Prior Publication Data

US 2019/0275481 A1 Sep. 12, 2019

(30) Foreign Application Priority Data

Jul. 26, 2016 (JP) ..... JP2016-145936

(51) Int. Cl.
*B01F 11/02* (2006.01)
*B01F 3/04* (2006.01)
(Continued)

(52) U.S. Cl.
CPC ..... *B01F 11/0208* (2013.01); *B01F 3/04* (2013.01); *B01F 3/0446* (2013.01); *B01F 5/00* (2013.01);
(Continued)

(58) Field of Classification Search
CPC ..... B01F 11/0208; B01F 11/0283; B01F 13/1022; B01F 15/00922;
(Continued)

(56) References Cited

U.S. PATENT DOCUMENTS

2004/0251566 A1* 12/2004 Kozyuk ..... B01F 5/0646 261/76

FOREIGN PATENT DOCUMENTS

JP 2003-102325 A 4/2003
JP 2006-346638 A 12/2006
(Continued)

OTHER PUBLICATIONS

Makuta et al., Generation of micro gas bubbles of uniform diameter in an ultrasonic field (1st Report). Transactions of the Japan Society of Mechanical Engineers. Series B, 70, 2758 (2004). [English abstract provided only].
(Continued)

*Primary Examiner* — Tony G Soohoo
(74) *Attorney, Agent, or Firm* — K&L Gates LLP; Louis C. Cullman; Georgia N. Kefallinos

(57) ABSTRACT

A bubble generation device includes: a metallic narrow tube (10) through which water passes; and a pump that pressure-feeds the water containing a gas component into the metallic narrow tube (10). A drawer (11) in which a path through which the water passes is narrower than the front and the rear thereof in the flow direction of the water is disposed on the inside of the metallic narrow tube (10). The drawer (11) has the rectangular cross section orthogonal to the flow direction. The gas component contained in the water is dissolved in the water by pressure-feeding the water to the drawer (11), bubbles are evolved due to a decrease in pressure in the drawer (11), turbulent flow is generated in the water in the drawer (11) to crush bubbles in the water by the
(Continued)

shearing force thereof, and bubbles are crushed by a shock wave caused by transonic flow occurring in the water that has exited from the drawer (11).

16 Claims, 10 Drawing Sheets

(51) Int. Cl.
*B01F 5/06* (2006.01)
*B01F 15/00* (2006.01)
*B01F 5/00* (2006.01)

(52) U.S. Cl.
CPC ..... *B01F 5/06* (2013.01); *B01F 5/0661* (2013.01); *B01F 11/0283* (2013.01); *B01F 15/00922* (2013.01)

(58) Field of Classification Search
CPC ..... B01F 2003/04858; B01F 3/04; B01F 3/0446; B01F 3/0451; B01F 5/00; B01F 5/06; B01F 5/0655; B01F 5/0661; B01F 5/106
See application file for complete search history.

(56) References Cited

FOREIGN PATENT DOCUMENTS

| | | | |
|---|---|---|---|
| JP | 2007-000843 | A | 1/2007 |
| JP | 2007-216149 | A | 8/2007 |
| JP | 2011-115745 | A | 6/2011 |
| WO | 2000/069550 | A1 | 11/2000 |
| WO | 2018/021182 | A1 | 2/2018 |

OTHER PUBLICATIONS

International Search Report for International Application No. PCT/JP2017/026463 dated Aug. 29, 2017 [search completed on Aug. 16, 2017]. [English translation provided].

* cited by examiner

PRESSURIZATION DISSOLUTION BY PRESSURE-FEEDING

GENERATION OF BUBBLE NUCLEI DUE TO NEGATIVE PRESSURE

BUBBLE GENERATION DEVICE, TUBULAR MEMBER, BUBBLE GENERATION METHOD, AND METHOD FOR MANUFACTURING BUBBLE GENERATION DEVICE

CROSS REFERENCE TO RELATED APPLICATIONS

This application is a national phase filing of PCT/JP2017/026463, filed Jul. 21, 2017, which claims the benefit of Japanese Application No. 2016-145936, filed Jul. 26, 2016, the entire disclosures each of which are incorporated herein by reference.

TECHNICAL FIELD

The present disclosure relates to a bubble generation device, a tubular member, a bubble generation method, and a method for manufacturing a bubble generation device.

BACKGROUND ART

In recent years, industrial utilization of bubbles having a diameter of 100 μm or less, called fine bubbles, has become widespread. In a liquid, fine bubbles have a very large surface area and float for a long period of time in comparison with a single large bubble having the same volume as that of the fine bubbles. Moreover, in comparison with large bubbles, fine bubbles facilitate dissolution of a gas in a liquid due to transfer of materials into the liquid through the surface of the bubbles and facilitate adsorption of impurities present in the liquid. Because fine bubbles have such various useful features, researches on utilization of fine bubbles having such features in water treatment, chemical reactors, and the like have been increasingly actively conducted, and rapid market development of such water treatment, chemical reactors, and the like in future has been expected. Under such a background, approaches have been made to proposing methods of generating fine bubbles in a liquid by using generation devices such as orifices and nozzles and analyzing the behaviors of generation of fine bubbles to experimentally and theoretically reveal the influences of various factors on the sizes of the generated fine bubbles.

Methods of generating fine bubbles are classified roughly into static and dynamic methods. Examples of the static methods include methods in which a porous membrane is used (see, for example, Patent Literature 1) and methods in which ultrasonic waves are used (see, for example, Non Patent Literature 1). In the case of using a porous body including a porous membrane, however, the quality (wettability) of the material of the porous body, the viscosity of a liquid, and the surface tension of the liquid affect the diameters of bubbles, use of a material with poor wetting characteristics, a highly viscous liquid, and a liquid having a high surface tension inhibits bubbles growing in a surface of a member from moving upward to leave the porous body due to the action of buoyancy, and therefore, bubbles of 100 μm or more as well as fine bubbles are generated. Porous bodies include porous bodies in which materials having low heat resistance, low chemical resistance, and low strength are used, and which are unsuitable for industrial use. In the case of using ultrasonic waves, an increase in the temperature of a liquid and damage to an instrument due to high-frequency vibrations become problematic, and there are also concerns about decomposition of the component of the liquid due to generation of radicals. Further, large energy for generating ultrasonic waves for generating fine bubbles is required.

In contrast to such static methods, a dynamic method in which a gas and a liquid are simultaneously introduced into a generation device is commonly used in a case in which the number of fine bubbles in the liquid is intended to be further increased. Examples of such dynamic methods include methods in which shear flow is used (see, for example, Patent Literature 2) and methods in which pressurization dissolution is performed (see, for example, Patent Literature 3). In a device disclosed in Patent Literature 2, a gas in a bubble state is physically fractured by shear flow with the energy of a liquid, generated by using a liquid pump, as driving force, to reduce the sizes of bubbles. In a device disclosed in Patent Literature 3, a gas pressurized and dissolved in a liquid is evolved as bubbles under low pressure. In these devices, however, large energy is required for generating fine bubbles by circulation of a liquid through such a liquid pump, and utilization of the devices with a highly viscous liquid is difficult.

Among generated fine bubbles, fine bubbles of 1 to 100 μm are referred to as microbubbles, and fine bubbles of less than 1 μm are referred to as ultrafine bubbles. Until now, the development of a fine bubble generation device, focusing on microbubbles, has been pursued. In these several years, however, technologies in which the bubble diameters and bubble density of ultrafine bubbles can be measured have been developed, and research and development on ultrafine bubbles have rapidly proceeded.

The bubble density of ultrafine bubbles is important for the research and development on the ultrafine bubbles. Although the average bubble diameter of ultrafine bubbles is around 100 to 200 nm without depending on a generation device, the bubble density of generated bubbles greatly varies according to the generation device. In the case of using such an existing microbubble generation device as described above, the limit of the bubble density of generated ultrafine bubbles is around 10 million/mL. Until now, devices and production methods for enhancing a bubble density have been proposed, and bubble densities of 100 million/mL to around 10 billion/mL have been reported.

CITATION LIST

Patent Literature

Patent Literature 1: Unexamined Japanese Patent Application Kokai Publication No. 2003-102325

Patent Literature 2: International Publication No. WO 2000/695503

Patent Literature 3: Unexamined Japanese Patent Application Kokai Publication No. 2006-346638

Non Patent Literature

Non Patent Literature 1: Toshinori Makuta and others, "Generation of Micro Gas Bubbles of Uniform Diameter in an Ultrasonic Field (1st Report)", Transactions of the Japan Society of Mechanical Engineers. Series B, 70, 2758 (2004)

SUMMARY OF INVENTION

Technical Problem

For example, however, with reference to the specifications of a high a bubble density-type ultrafine bubble generation device capable of achieving a bubble density of around 800 million/m L, the structure of the interior of the generation device is complicated, and a high pump discharge pressure of 1.0 MPa is required for allowing a liquid to pass through the complicated interior. In spite of such a high pump discharge pressure, the flow rate of treatment liquid is as very low as 4.7 L/min, and time is required for generating a large amount of ultrafine bubbles.

The present disclosure was made under such circumstances with an objective of providing a bubble generation device, a tubular member, a bubble generation method, and a method for manufacturing a bubble generation device, in which a large amount of high-density bubbles having further small diameters of, for example, less than 1 μm can be generated in a short time without requiring a high pump discharge pressure.

Solution to Problem

In order to achieve the objective described above, a bubble generation device according to a first aspect of the present disclosure includes:

a tubular member with an interior through which a liquid containing a gas component passes; and a pump that pressure-feeds the liquid into the tubular member, wherein a drawer in which a path through which the liquid passes is narrower than a front and a rear thereof in a flow direction of the liquid is disposed on an inside of the tubular member, the drawer has a rectangular cross section orthogonal to the flow direction, the gas component contained in the liquid is dissolved in the liquid by pressure-feeding the liquid to the drawer, and bubbles are then evolved due to a decrease in pressure in the drawer, a negative pressure that is lower than atmospheric pressure is generated in the drawer to generate bubble nuclei, turbulent flow is generated in the liquid in the drawer to crush bubbles in the liquid by shearing force thereof, and bubbles are crushed by a shock wave caused by transonic flow occurring in the liquid that has exited from the drawer.

In this case, in the tubular member, a length of the drawer in the flow direction of the liquid may be a length in which the liquid passes through the drawer at a pump pressure of less than 1.0 MPa, bubbles are evolved due to a decrease in pressure, and bubbles are crushed due to shearing force of turbulent flow.

In the tubular member, the drawer may have a flat cross section orthogonal to the flow direction.

In the tubular member, an inner wall, including the drawer, in the front and the rear thereof in the flow direction may have a streamlined shape.

In the tubular member, the drawer may be a plurality of drawers, and the plurality of drawers may be disposed in series with a space provided therebetween.

The space between the drawers in the tubular member may be a space allowing a flow rate of the liquid that has exited from the drawers to return to a flow rate of the liquid input into the tubular member.

The tubular member may be a plurality of tubular members and the plurality of tubular members may be disposed in parallel in a flow passage for the liquid.

A binder member may be encapsulated between the tubular members.

The tubular member may be made of a metal.

A tubular member according to a second aspect of the present disclosure is a tubular member with an interior through which a liquid passes, wherein a drawer in which a path through which the liquid passes is narrower than a front and a rear thereof in a flow direction of the liquid is disposed, the drawer has a rectangular cross section orthogonal to the flow direction, a gas component contained in the liquid is dissolved in the liquid by pressure-feeding the liquid to the drawer, and bubbles are then evolved due to a decrease in pressure in the drawer, a negative pressure that is lower than atmospheric pressure is generated in the drawer to generate bubble nuclei, turbulent flow is generated in the liquid in the drawer to crush bubbles in the liquid by shearing force thereof, and bubbles are crushed by a shock wave caused by transonic flow occurring in the liquid that has exited from the drawer.

A bubble generation method according to a third aspect of the present disclosure includes:

allowing a liquid containing a gas component pressure-fed by a pump to pass into a tubular member in which a drawer, in which a path through which the liquid passes is narrower than a front and a rear thereof in a flow direction of the liquid, and which has a rectangular cross section orthogonal to the flow direction, is disposed;

dissolving, in the liquid, the gas component contained in the liquid by pressure-feeding the liquid to the drawer and then evolving bubbles due to a decrease in pressure in the drawer;

generating a negative pressure that is lower than atmospheric pressure in the drawer to generate bubble nuclei;

generating turbulent flow in the liquid in the drawer to crush bubbles in the liquid by shearing force thereof; and crushing bubbles by a shock wave caused by transonic flow occurring in the liquid that has exited from the drawer.

In this case, the liquid may be allowed to flow into the tubular member in which the plurality of drawers are formed in series.

The liquid may be allowed to flow into the plurality of tubular members that are tied in parallel in a state in which both ends thereof are opened and that are fixed with a binder member.

A method for manufacturing a bubble generation device according to a fourth aspect of the present disclosure includes:

a step of pressing a portion of a metallic narrow tube having a uniform inner diameter to form a drawer, in which a path through which the liquid passes is narrower than a front and a rear thereof in a flow direction of the liquid, and which has a rectangular cross section orthogonal to the flow direction, on an inside of the metallic narrow tube, wherein in the step, the metallic narrow tube is pressed so that the shape of the drawer is a shape in which:

a gas component contained in the liquid is dissolved in the liquid by pressure-feeding the liquid to the drawer, and bubbles are then evolved due to a decrease in pressure in the drawer;

a negative pressure that is lower than atmospheric pressure in the drawer is generated to generate bubble nuclei;

turbulent flow is generated in the liquid in the drawer to crush bubbles in the liquid by shearing force thereof; and bubbles are crushed by a shock wave caused by transonic flow occurring in the liquid that has exited from the drawer.

In this case, in the step, the drawer may be a plurality of drawers, and the plurality of drawers may be formed at respective positions in the metallic narrow tube.

A step of tying the metallic narrow tubes, in which the drawer is formed, in parallel in a state in which both ends thereof are opened, and fixing the metallic narrow tubes with a binder member may be further included.

Advantageous Effects of Invention

According to the present disclosure, a drawer, in which a path through which a liquid passes is narrower than the front and the rear thereof in the flow direction of the liquid, and which has the rectangular cross section orthogonal to the flow direction, is disposed on the inside of a tubular member. Therefore, in the case of allowing a liquid containing a gas component to flow into the tubular member by a pump, the gas component to be mixed into the liquid is dissolved in the liquid by pressure-feeding the liquid to the drawer, bubbles are evolved due to a decrease in pressure in the drawer, and bubbles are generated due to generation of a negative pressure that is lower than atmospheric pressure in the drawer. In the drawer, bubbles are generated due to generation of a negative pressure that is lower than atmospheric pressure. In the drawer, turbulent flow is generated in the liquid, and bubbles in the liquid are crushed by the shearing force thereof. Further, bubbles are crushed by a shock wave caused by transonic flow occurring in the liquid that has exited from the drawer. Such combined actions enable, for example, ultrafine bubbles of less than 1 μm to be highly densely generated. In other words, according to the present disclosure, ultrafine bubbles of less than 1 μm can be generated due to the above-described combined actions with various principles only by allowing a liquid to pass through the tubular member with the drawer, which has a simple configuration, and therefore, a large amount of high-density bubbles having further small diameters of, for example, less than 1 μm can be generated in a short time without requiring a high pump discharge pressure.

DESCRIPTION OF EMBODIMENTS

Embodiments of the present disclosure will be described in detail below with reference to the drawings.

Figure 1:
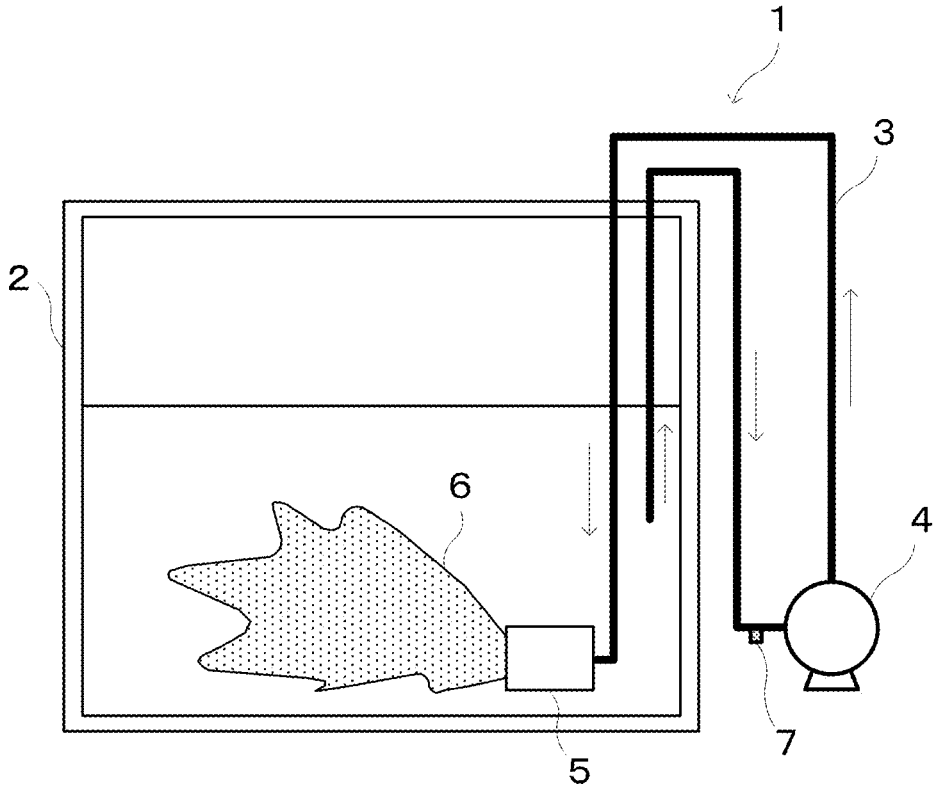
FIG. 1 is a schematic view illustrating the configuration of a bubble generation device according to an embodiment of the present disclosure.

As illustrated in FIG. 1, a bubble generation device 1, which is a device that generates ultrafine bubbles 6 having a radius of less than 1 μm, is placed in a water tank 2 in which water as a liquid is put. The bubble generation device 1 includes a pipe 3, a pump 4, and a bubble generator 5.

One end of the pipe 3 is arranged in the water in the water tank 2. The pipe 3 has a circular structure in which the pipe 3 extends from the interior of the water tank 2 to the outside and returns again into the water tank 2. In the outside of the water tank 2, the pump 4 is inserted into the pipe 3. The pump 4 is a liquid pump. By driving the pump 4, water in the water tank 2 is sucked into the interior of the pipe 3 and returns again into the water tank 2 through the pump 4. As the pump 4, a commercially available pump having a pump pressure of less than 1.0 MPa can be used. A gas inlet 7 for taking air into the pipe 3 is disposed in the primary side of the pump 4 in the pipe 3.

When water is sucked into the pump 4, the suction force thereof (negative pressure generated in the primary side of the pump 4) allows a gas (for example, air) to enter through the gas inlet 7 from the outside to be mixed into water. Accordingly, water (water in the secondary side of the pump 4) flowing from the pump 4 to the pipe 3 contains a gas component.

Figure 2:
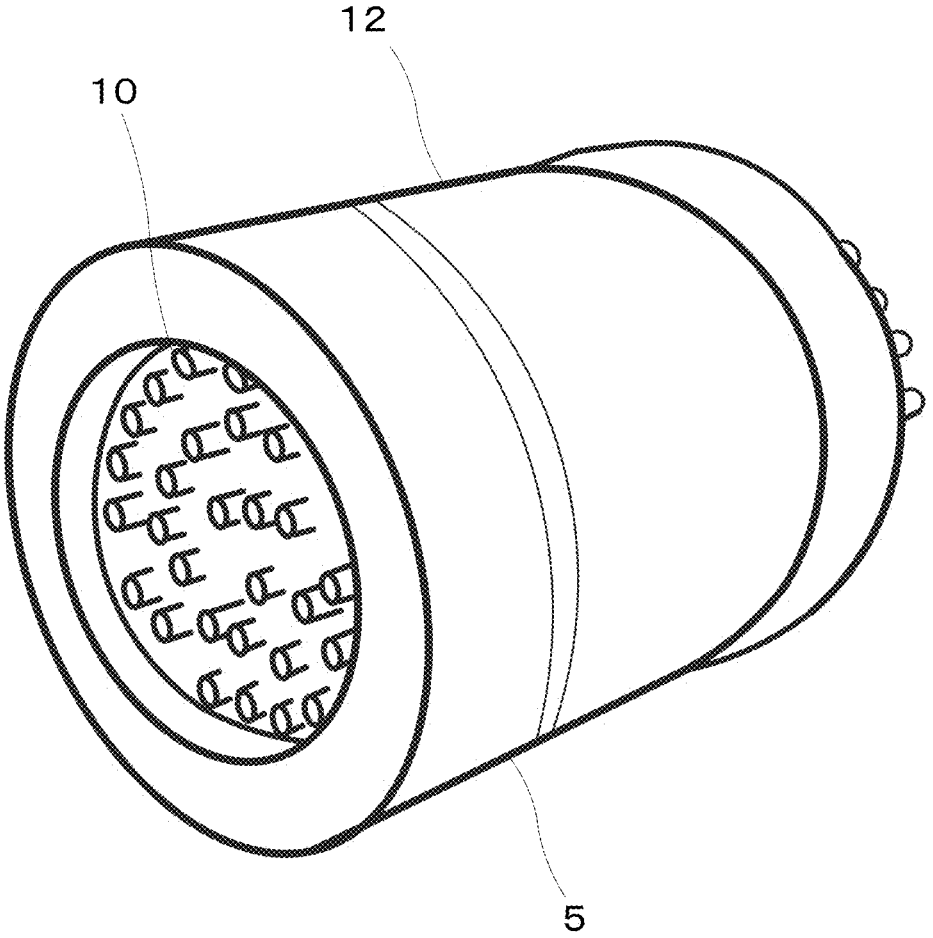
FIG. 2 is a perspective view illustrating the structure of a bubble generator included in the bubble generation device of FIG. 1.

The bubble generator 5 is attached to the other end of the pipe 3, that is, a discharger for water, and discharges water including the ultrafine bubbles 6 into the water tank 2. As illustrated in FIG. 2, the bubble generator 5 has a structure in which multiple metallic narrow tubes 10 are tied in parallel. A portion between the metallic narrow tubes 10 is sealed with a binder member 12 in a state in which both ends of each metallic narrow tube 10 are opened. For example, a resin can be used as the binder member 12.

Water that has exited from the other end of the pipe 3 passes through the interior of any of the metallic narrow tubes 10 of the bubble generator 5 and is discharged to the water tank 2. If the metallic narrow tubes 10 are nozzles for discharging the ultrafine bubbles 6, the bubble generator 5 is a multi-hole nozzle. The reason why the metallic narrow tubes 10 which are tubular members made of a metal are adopted is because the metallic narrow tubes 10 have favorable wettability and high strength. Examples of such a metal include stainless steel.

Figure 3A:
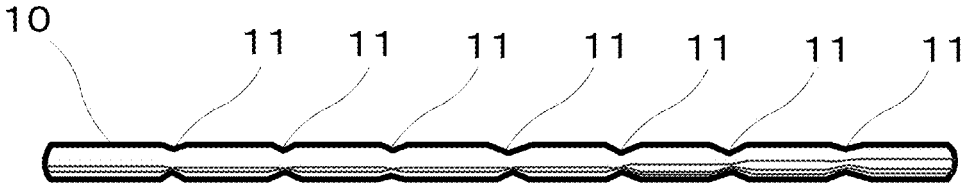
FIG. 3A is a side view illustrating the structure (1) of a metallic narrow tube as a tubular member included in a bubble generator.
Figure 3B:
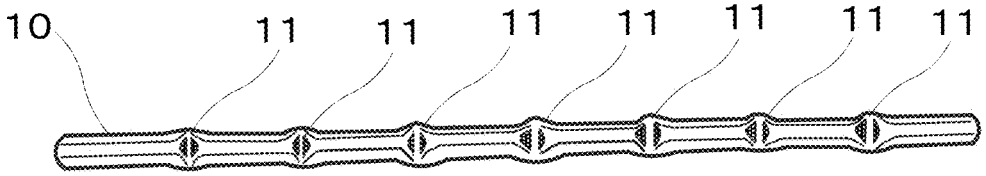
FIG. 3B is a side view illustrating the structure (2) of a metallic narrow tube as a tubular member included in a bubble generator.

As illustrated in FIG. 3A and FIG. 3B, portions made to be flat by a press are disposed at multiple locations in the metallic narrow tubes 10. In the present embodiment, such a portion is referred to as a drawer 11. The ultrafine bubbles 6 are formed by the drawer 11.

Figure 4:
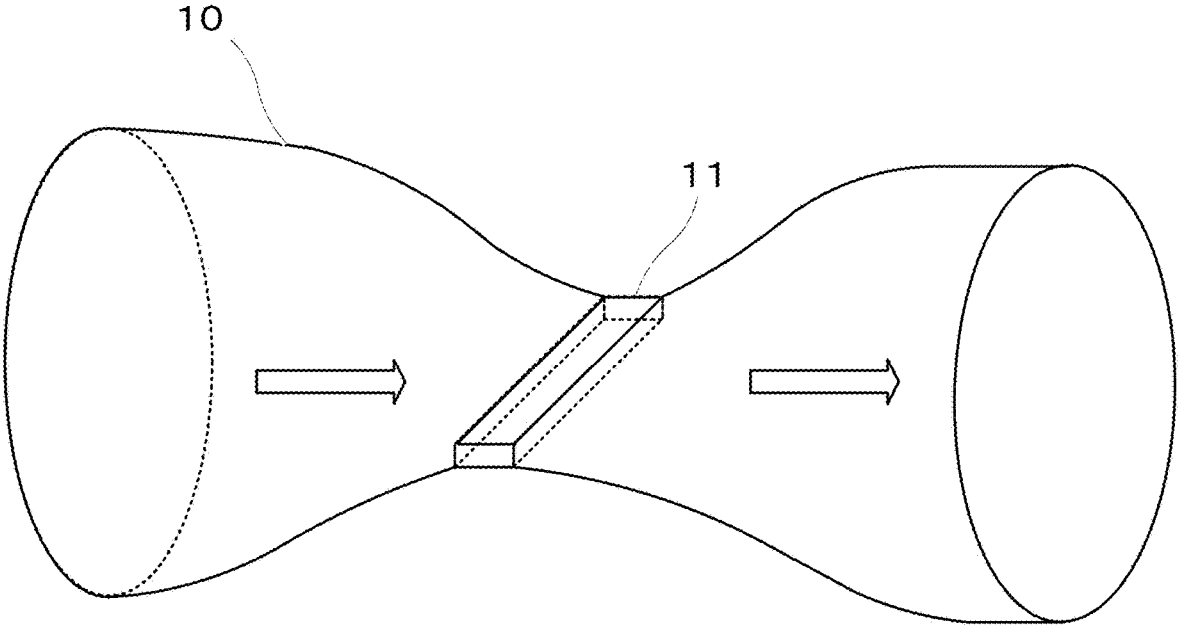
FIG. 4 is a schematic view of a drawer and the front and the rear thereof.

As illustrated in FIG. 4, a cross section of the interior of the drawer 11 is a flat shape (rectangular shape). The drawer 11 generates the ultrafine bubbles 6 due to four actions described below.

(1) Pressurization Dissolution by Pressure-Feeding

Figure 5:
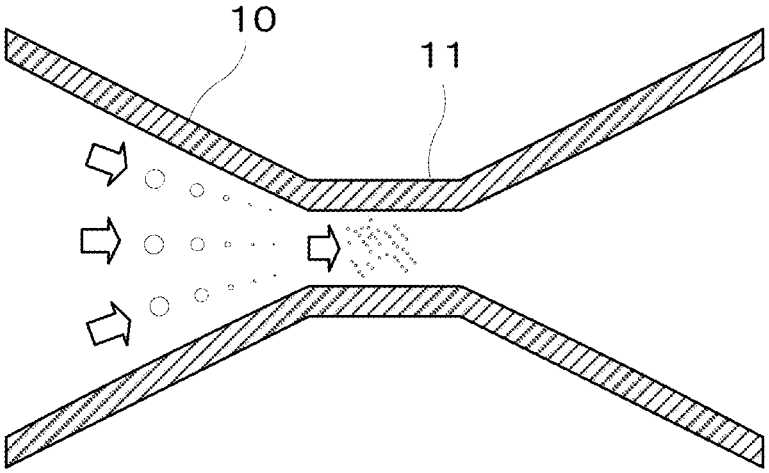
FIG. 5 is a cross-sectional view illustrating pressurization dissolution by pressure-feeding.

As illustrated in FIG. 5, pressure-feeding by pump pressure allows the pressure of water flowing upstream of the drawer 11 to be increased by a decrease in the cross-sectional area of each of the metallic narrow tubes 10 in a flow direction to dissolve, in water, an air component contained in the water. At this time, large bubbles (bubbles of 1 μm or more) in the water disappear. When the water in which the bubbles have disappeared enters the drawer 11, the flow rate of the water is increased to decrease the pressure of the water. The decrease in the pressure allows small bubbles to be evolved.

(2) Generation of Bubble Nuclei Due to Negative Pressure

Figure 6:
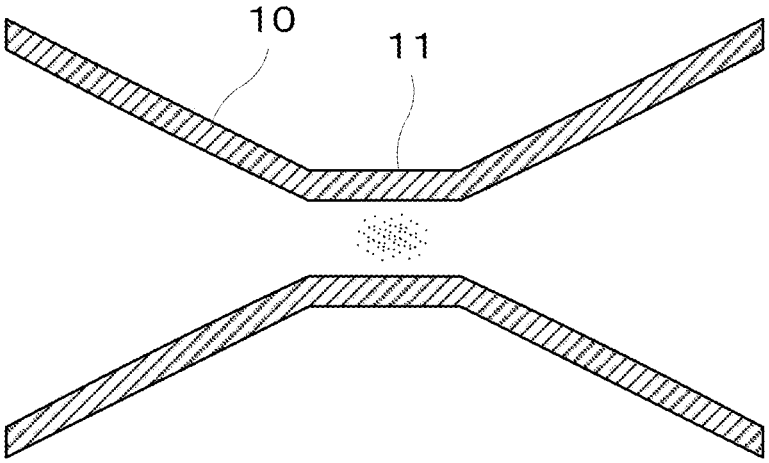
FIG. 6 is a cross-sectional view illustrating generation of bubble nuclei due to a negative pressure.

As illustrated in FIG. 6, in the drawer 11, the flow rate of water is increased, and therefore, a negative pressure that is lower than atmospheric pressure is generated. As a result, fine bubble nuclei are generated in water flow, as well as a phenomenon in which the bubbles of a gas subjected to the pressurization dissolution described above are evolved occurs. Such a phenomenon in which the bubble nuclei are generated is referred to as cavitation.

(3) Crushing of Bubbles by Shear Flow

Figure 7:
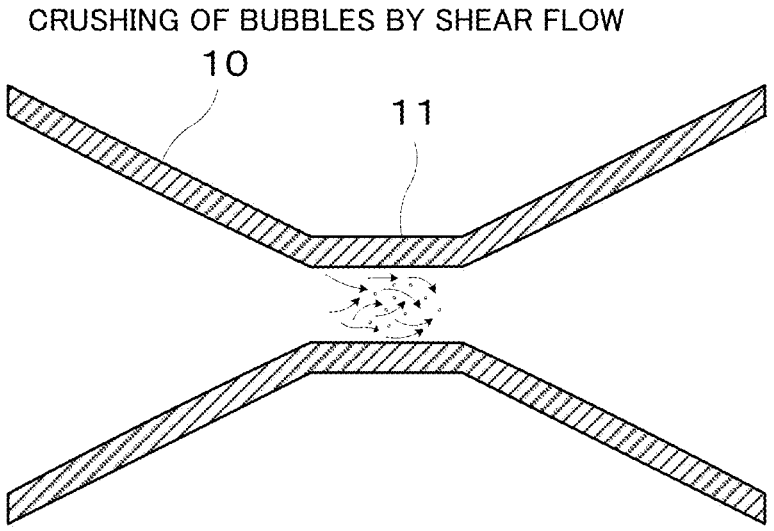
FIG. 7 is a cross-sectional view illustrating of bubbles by shear flow.

A Reynolds number is, for example, around $4.6\times10^3$ in the metallic narrow tube 10 (the portion other than the drawer 11) whereas a Reynolds number is as very high as, for example, around $1.6\times10^4$ in the drawer 11. As a result, a fully developed turbulent flow region is formed in the drawer 11, as illustrated in FIG. 7. The turbulent flow allows bubbles to receive shearing force and to be fractured.

(4) Crushing of Bubbles by Shock Wave

Figure 8:
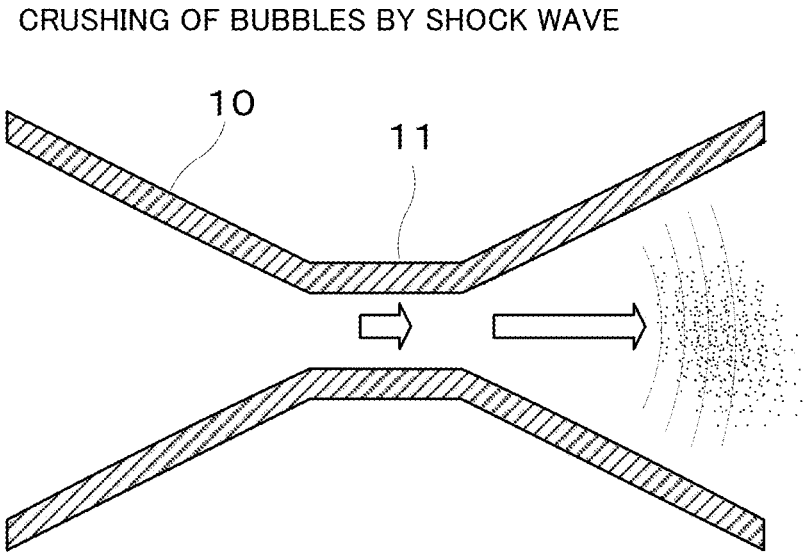
FIG. 8 is a cross-sectional view illustrating crushing of bubbles by a shock wave.

The Mach number of the flow of water in the metallic narrow tube 10 (the portion other than the drawer 11) is, for example, 0.007, exhibiting a subsonic speed. In contrast, the Mach number in the drawer 11 is, for example, 0.7 or more, exhibiting transonic flow, as illustrated in FIG. 8. In a flow region in a portion of the transonic flow, a sound speed is exceeded, and a shock wave is generated. The shock wave causes bubbles to be finer.

In the metallic narrow tube 10, the length of the drawer 11 in the flow direction of water is set at the shortest length in which (2) evolution of bubbles due to a decrease in pressure and (3) Crushing of bubbles by the shearing force of turbulent flow occur. The reason why the shortest length in which the phenomena (2) and (3) occur is achieved is because the pressure loss of a pump pressure in the drawer 11 is increased with increasing the length of the drawer 11 in the flow direction, and therefore, it is necessary to increase the pump pressure of the pump 4.

In the present embodiment, the shape of a cross section orthogonal to the flow direction of water in the drawer 11 is a flat shape (rectangular shape). Such a manner enables the effect of crushing bubbles to be improved in comparison with a case in which the cross-sectional shape of the drawer 11 is allowed to be a circular shape having the same cross-sectional area. Moreover, the pressure loss of the drawer 11 can be reduced as much as possible. As a result, the pump pressure of the pump 4 can be lowered.

As illustrated in FIG. 4, the shape of the inner wall of the metallic narrow tube 10, including the drawer 11 in the front and the rear thereof, is a seamless, streamlined shape of which a surface has no level difference. Such a manner enables the pressure loss of the pump pressure in the interior of the metallic narrow tube 10 to be reduced, and can therefore result in a decrease in the pump pressure of the pump 4.

Figure 9:
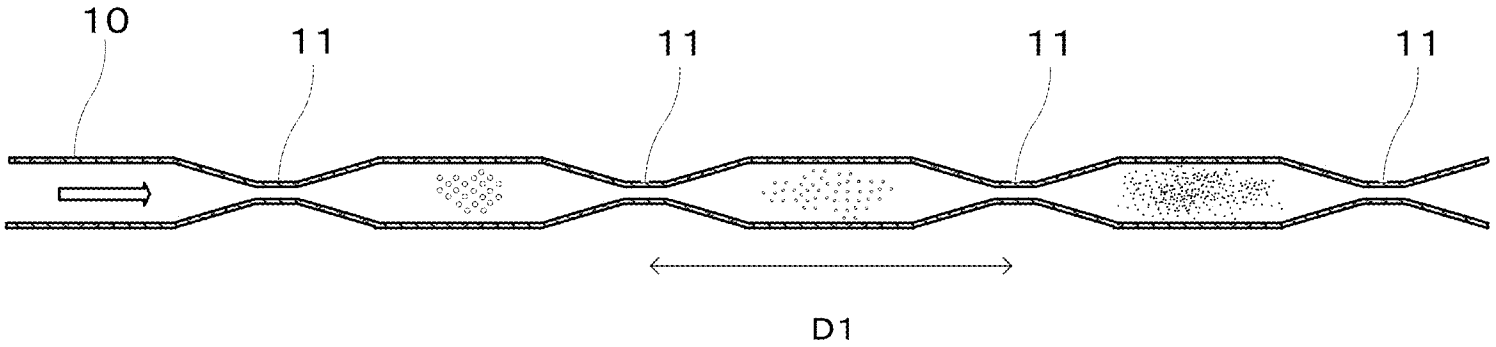
FIG. 9 is a view illustrating a state in which multiple drawers are formed in series, and bubbles are generated in the drawers.

In the metallic narrow tube 10, such multiple drawers 11 are disposed in series with a space provided therebetween, and the above-described phenomena (1) to (4) occur, whereby fine bubbles are repeatedly generated, in each drawer 11, as illustrated in FIG. 9. The diameters of generated bubbles are gradually decreased while the bubbles further pass through the drawers 11, and the ultrafine bubbles 6 having a diameter of less than 1 μm are finally generated.

In the metallic narrow tube 10, the space between drawers 11 adjacent to each other is D1. The space D1 is a space that is sufficiently long enough for the flow rate of water that has exited from each drawer 11 to return to the flow rate of water input into the metallic narrow tube 10. Such a manner enables the above-described phenomena (1) to (4) to reliably occur in each drawer 11.

In the bubble generator 5, the multiple metallic narrow tubes 10 are disposed in parallel in a flow passage for water. Such a manner enables the ultrafine bubbles 6 to be simultaneously generated in each metallic narrow tube 10, and can therefore allow the amount of the generated ultrafine bubbles 6 to be easily increased. The amount of the generated ultrafine bubbles 6 is increased with increasing the number of the metallic narrow tubes 10. The amount of the generated ultrafine bubbles 6 can be adjusted only by adjusting the number of the metallic narrow tubes 10.

Figure 10:
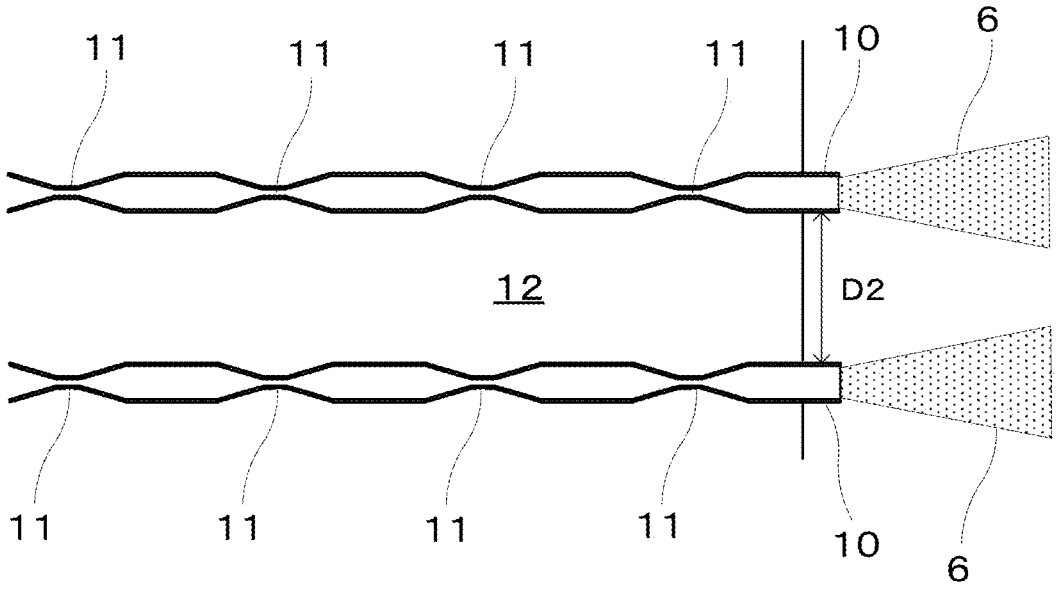
FIG. 10 is a view illustrating the state of ultrafine bubbles discharged from a bubble generator.

In the bubble generator 5, the binder member 12 is encapsulated between the metallic narrow tubes 10, as illustrated in FIG. 10. Such a manner can prevent the ultrafine bubbles 6 discharged from each metallic narrow tube 10 from interfering with each other and from allowing bubbles to adhere to each other and to be integrated with each other.

An attempt was actually made to investigate the capability of the bubble generation device 1 to generate the ultrafine bubbles 6. Generation conditions are as follows. First, distilled water was used as the liquid, and air was used as the gas. The number of the metallic narrow tubes 10 in the bubble generator 5 was set at 34, the number of drawers 11 per metallic narrow tube 10 was set at seven, and the space between the drawers 11 was set at 5 mm. Moreover, the shape and size of a cross section of each drawer 11 were set at a rectangular shape of 0.2 mm×1.09 mm, and the length of each drawer 11 was set at 0.2 mm. Moreover, the pump pressure of the pump was set at 0.3 MPa, the flow rate of the liquid was set at 8.8 L/min, and such control that a water temperature of 30° C. or less was achieved was performed.

Figure 11:
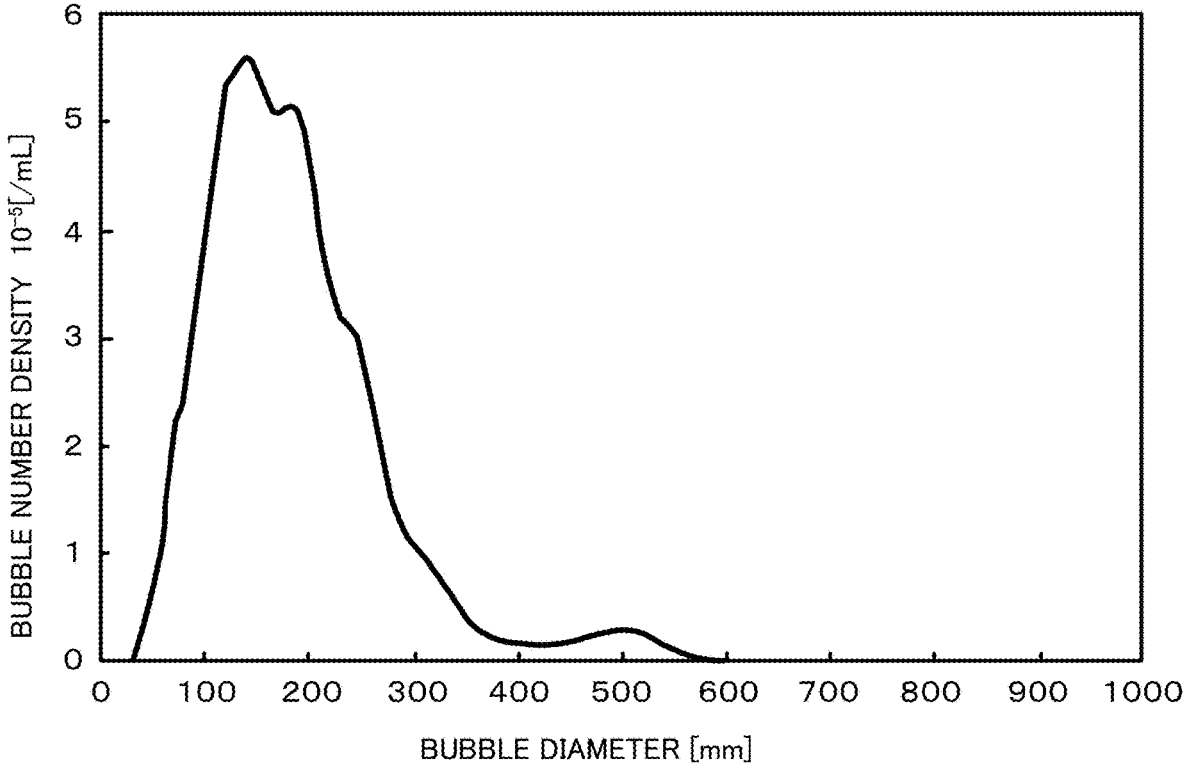
FIG. 11 is a graph illustrating a relationship between the radius of a generated bubble and a bubble number density.

Bubbles were actually generated using the bubble generation device 1. The bubble diameters of bubbles generated in such a case and the bubble number densities corresponding to the bubble diameters are graphed as illustrated in FIG. 11. As illustrated in FIG. 11, it was confirmed that a number of the ultrafine bubbles 6 having a diameter of less than 1 μm were generated by the bubble generation device 1, and the bubble diameters of most of the bubbles were 100 nm or more and 200 nm or less. The bubble density of the generated bubbles was 981 million/mL.

Figure 12:
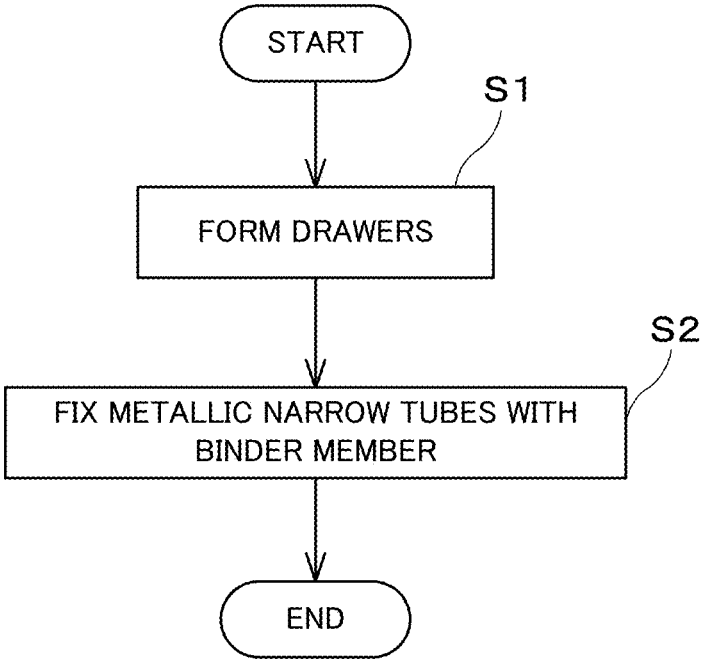
FIG. 12 is a flowchart of a method for manufacturing a bubble generator.

The bubble generator 5 can be easily manufactured. As illustrated in FIG. 12, first, a portion of each metallic narrow tube 10 having a uniform inner diameter is pressed to form each drawer 11, in which a path through which water passes is narrower than the front and the rear thereof in the flow direction of the water, on the inside of the metallic narrow tube 10 (step S1). In this step, the metallic narrow tube 10 is pressed so that the shape of the drawer 11 is such a shape that a gas component contained in water is dissolved in the water by pressure-feeding the water to the drawer 11, bubbles are evolved due to a decrease in pressure in the drawer 11, turbulent flow is generated in the water in the drawer 11, bubbles in the water are crushed by the shearing force thereof, and bubbles are crushed by a shock wave caused by transonic flow occurring in the water that has exited from the drawer 11.

In the step S1, the drawers 11 are formed at multiple positions in the metallic narrow tubes 10. As a result, the metallic narrow tubes 10 including the drawers 11 are formed. In the step S1, the multiple drawers 11 are formed.

In the present embodiment, the formation of the drawers 11 by a press enables the shape of the inner wall of the drawers 11 and the peripheries of the drawers 11 to be streamlined, and can result in a decrease in the pressure loss of a pump pressure at which water is allowed to internally flow.

Subsequently, the multiple metallic narrow tubes 10 in which the drawers 11 are formed are tied in parallel, and fixed with the binder member 12 in a state in which both ends thereof are not blocked (step S2). As a result, the bubble generator 5 is formed. The filling of the binder member 12 into between the metallic narrow tubes 10 in such a manner prevents the ultrafine bubbles 6 discharged from each metallic narrow tube 10 from interfering with each other and from adhering to each other and being integrated with each other.

Then, the bubble generator 5 is attached to an end of the pipe 3, the pump 4 is attached to the pipe 3, and the bubble generation device 1 is placed in the water tank 2 as illustrated in FIG. 1, thereby completing the placement of the bubble generation device 1.

According to the present embodiment, the drawers 11 in which a path through which water passes is narrower than the front and the rear thereof in the flow direction of the water are disposed on the insides of the metallic narrow tubes 10, as described in detail above. Therefore, when water containing a gas component (air) is allowed to flow into the metallic narrow tubes 10 by the pump 4, the gas component mixed into the water is dissolved in the water by pressure-feeding the water to the drawers 11, and bubbles are then evolved due to a decrease in pressure in the drawers 11. In the drawer 11, bubbles are generated by generating a negative pressure that is lower than atmospheric pressure. In the drawer 11, bubbles are generated by generating a negative pressure that is lower than atmospheric pressure. Further, turbulent flow is generated in water in the drawers 11, bubbles in the water are crushed by the shearing force thereof, and bubbles are crushed by a shock wave caused by transonic flow occurring in the water that has exited from the drawers 11. Such combined actions enable, for example, fine bubbles of less than 1 μm to be generated.

In other words, bubbles of less than 1 μm can be generated due to the combined action with various principles only by allowing water to pass through the metallic narrow tubes 10 with the drawers 11, which have a simple configuration, and therefore, a large amount of bubbles having further small diameters of, for example, less than 1 μm, with a high density (for example, a bubble density of 981 million/mL), can be generated in a short time, for example, at around 0.3 MPa, without requiring a high pump discharge pressure (1.0 MPa).

In the present embodiment, the length of each drawer 11 in the flow direction is set at the shortest length in which a liquid passes at a pump pressure of less than 1.0 MPa, and the evolution of bubbles and the crushing of bubbles by shearing force due to turbulent flow are possible. The pressure loss of the pump pressure due to the drawer 11 can be minimized by decreasing the length of the drawer 11 in the flow direction in such a manner.

In the present embodiment, the shape of a cross section orthogonal to the flow direction of each drawer 11 is a flat shape. This is because the flat cross-sectional shape can be expected to result in the less influence of the inner walls of the metallic narrow tubes 10, the more turbulence of a flowing liquid, and the crushing of more bubbles. However, the cross-sectional shapes of the drawers 11 may be circular, oval, star, triangular, and other polygonal shapes. Multiple holes or slits disposed in parallel in the metallic narrow tubes 10 may also be used as the drawers 11.

In the present embodiment, the shape of the inner wall of the front and the rear of each drawer 11 is streamlined. As a result, the pressure loss of the pump pressure due to the metallic narrow tubes 10 can be further lowered. However, the present disclosure is not limited thereto. For example, there may be a level difference between a drawer 11 and another portion, without a tapered portion communicating with the drawer 11. The shape of the inner tube of each metallic narrow tube 10, such as the inclination of the tapered portion, is not limited as long as the above-described effects (1) to (4) occur.

In the present embodiment, the multiple drawers 11 are disposed in series with a space D1 provided therebetween in the metallic narrow tubes 10. As a result, ultrafine bubbles 6 can be generated multiple times by one metallic narrow tube 10, and therefore, the generation density of the ultrafine bubbles 6 can be further increased. In the embodiment described above, the space between the drawers 11 is constant; however, the space need not be constant. Moreover, the number of drawers 11 in each metallic narrow tube 10 is optional.

All the cross-sectional shapes and sizes of drawers 11 formed in metallic narrow tubes 10 are not necessarily the same. For example, a cross-sectional size may be reduced according to a liquid flow direction. Even when all the cross-sectional shapes of the drawers 11 are flat shapes, the flat directions of the shapes are not necessarily the same directions.

In the present embodiment, the space D1 between drawers 11 adjacent to each other is a space in which the flow rate of water that has exited from the drawers 11 returns to the flow rate of the water before being input into the drawers 11. Such a manner enables the reliable generation of the ultrafine bubbles 6 in the above-described processes (1) to (4) in each drawer 11.

In the present embodiment, the multiple metallic narrow tubes 10 are disposed in parallel in the flow passage for water. As a result, a large amount of the ultrafine bubbles 6 can be generated at one time. The number and arrangement of the metallic narrow tubes 10 are not limited, and are optional. The number of the metallic narrow tubes 10 can be adjusted according to the required amount of the generated ultrafine bubbles 6.

In the present embodiment, the binder member 12 is filled into between the metallic narrow tubes 10 connected in parallel, and the metallic narrow tubes 10 are spaced. Such a manner can inhibit ultrafine bubbles 6 output from each metallic narrow tube 10 from interfering with each other and from being integrated with each other.

In the present embodiment, the metallic narrow tube 10 including the drawers 11 can be easily manufactured only by pressing a metallic narrow tube having a uniform inner diameter. Accordingly, it is not necessary to use a relatively expensive fine processing technology such as metal cutting or etching, and the device can be inexpensively manufactured.

However, a drawer 11 may be formed at only one place in a metallic narrow tube 10. The sizes, lengths, number, spacing, and the like of the drawers 11 per metallic narrow tube 10 depend on the pump pressure of the pump 4, and the like, and the design information of the drawers 11 can be easily determined by fluid analysis simulation software.

In the above embodiment, the water (distilled water) is used as the liquid; however, the present disclosure is not limited thereto. A more highly viscous liquid is also acceptable.

In the above-described embodiment, the metallic narrow tubes 10 are used; however, a member including another material such as ceramic can also be used as long as having favorable wettability. A member including a material with poor wettability is unsuitable for generating bubbles because bubbles are prone to adhere to the inner wall of the member.

In the above-described embodiment, the resin is used as the binder member 12; however, a member including another material such as a metal having high heat resistance, high chemical resistance, and high strength may be used.

In the above-described embodiment, the drawers 11 are formed by press working; however, the drawers 11 may be formed by another method.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the priority of Japanese Patent Application No. 2016-145936, filed on Jul. 26, 2016, the entire disclosure of which is incorporated by reference herein.

INDUSTRIAL APPLICABILITY

The present disclosure can be utilized for generating ultrafine bubbles which are bubbles having a diameter of less than 1 μm (for example, 100 nm to 200 nm). The present disclosure can be expected to be applied and expanded not only to, for example, cosmetics and the pharmaceutical products but also to high-value-added fields such as various industrial fields such as environmental and stock raising fields.

REFERENCE SIGNS LIST

1 bubble generation device
2 Water tank
3 Pipe
4 Pump
5 Bubble generator
6 Ultrafine bubbles
7 Gas inlet
10 Metallic narrow tube
11 Drawer
12 Binder member

The invention claimed is:

1. A bubble generation device comprising:

a tubular member with an interior through which a liquid containing a gas component passes; and a pump that pressure-feeds the liquid into the tubular member, wherein a drawer in which a path through which the liquid passes is narrower than a front and a rear thereof in a flow direction of the liquid is disposed on an inside of the tubular member, the drawer has a rectangular cross section orthogonal to the flow direction, the gas component contained in the liquid is dissolved in the liquid by pressure-feeding the liquid to the drawer, and bubbles are then evolved due to a decrease in pressure in the drawer, a negative pressure that is lower than atmospheric pressure is generated in the drawer to generate bubble nuclei, turbulent flow is generated in the liquid in the drawer to crush bubbles in the liquid by shearing force thereof, and bubbles are crushed by a shock wave caused by transonic flow occurring in the liquid that has exited from the drawer.

2. The bubble generation device according to claim 1, wherein in the tubular member, a length of the drawer in the flow direction of the liquid is a length in which the liquid passes through the drawer at a pump pressure of less than 1.0 MPa, bubbles are evolved due to a decrease in pressure, and bubbles are crushed due to shearing force of turbulent flow.

3. The bubble generation device according to claim 1, wherein in the tubular member, the drawer has a flat cross section orthogonal to the flow direction.

4. The bubble generation device according to claim 1, wherein in the tubular member, an inner wall, comprising the drawer, in the front and the rear thereof in the flow direction has a streamlined shape.

5. The bubble generation device according to claim 1, wherein in the tubular member, the drawer is a plurality of drawers, and the plurality of drawers are disposed in series with a space provided therebetween.

6. The bubble generation device according to claim 1, wherein the space between the drawers in the tubular member is a space allowing a flow rate of the liquid that has exited from the drawers to return to a flow rate of the liquid input into the tubular member.

7. The bubble generation device according to claim 1, wherein the tubular member is a plurality of tubular members and the plurality of tubular members are disposed in parallel in a flow passage for the liquid.

8. The bubble generation device according to claim 7, wherein a binder member is encapsulated between the tubular members.

9. The bubble generation device according to claim 1, wherein the tubular member is made of a metal.

10. A tubular member with an interior through which a liquid passes, wherein a drawer in which a path through which the liquid passes is narrower than a front and a rear thereof in a flow direction of the liquid is disposed, the drawer has a rectangular cross section orthogonal to the flow direction, a gas component contained in the liquid is dissolved in the liquid by pressure-feeding the liquid to the drawer, and bubbles are then evolved due to a decrease in pressure in the drawer, a negative pressure that is lower than atmospheric pressure is generated in the drawer to generate bubble nuclei, turbulent flow is generated in the liquid in the drawer to crush bubbles in the liquid by shearing force thereof, and bubbles are crushed by a shock wave caused by transonic flow occurring in the liquid that has exited from the drawer.

11. A bubble generation method comprising:

allowing a liquid containing a gas component pressure-fed by a pump to pass into a tubular member in which a drawer, in which a path through which the liquid passes is narrower than a front and a rear thereof in a flow direction of the liquid, and which has a rectangular cross section orthogonal to the flow direction, is disposed;

dissolving, in the liquid, the gas component contained in the liquid by pressure-feeding the liquid to the drawer and then evolving bubbles due to a decrease in pressure in the drawer;

generating a negative pressure that is lower than atmospheric pressure in the drawer to generate bubble nuclei;

generating turbulent flow in the liquid in the drawer to crush bubbles in the liquid by shearing force thereof; and crushing bubbles by a shock wave caused by transonic flow occurring in the liquid that has exited from the drawer.

12. The bubble generation method according to claim 11, wherein the liquid is allowed to flow into the tubular member in which the plurality of drawers are formed in series.

13. The bubble generation method according to claim 11 or 12, wherein the liquid is allowed to flow into the plurality of tubular members that are tied in parallel in a state in which both ends thereof are opened and that are fixed with a binder member.

14. A method for manufacturing a bubble generation device, comprising:

a step of pressing a portion of a metallic narrow tube having a uniform inner diameter to form a drawer, in which a path through which the liquid passes is narrower than a front and a rear thereof in a flow direction of the liquid, and which has a rectangular cross section orthogonal to the flow direction, on an inside of the metallic narrow tube, wherein in the step, the metallic narrow tube is pressed so that the shape of the drawer is a shape in which:

a gas component contained in the liquid is dissolved in the liquid by pressure-feeding the liquid to the drawer, and bubbles are then evolved due to a decrease in pressure in the drawer;

a negative pressure that is lower than atmospheric pressure in the drawer is generated to generate bubble nuclei;

turbulent flow is generated in the liquid in the drawer to crush bubbles in the liquid by shearing force thereof; and bubbles are crushed by a shock wave caused by transonic flow occurring in the liquid that has exited from the drawer.

15. The method for manufacturing a bubble generation device according to claim 14, wherein in the step, the drawer is a plurality of drawers, and the plurality of drawers are formed at respective positions in the metallic narrow tube.

16. The method for manufacturing a bubble generation device according to claim 14, further comprising:

a step of tying the metallic narrow tubes, in which the drawer is formed, in parallel in a state in which both ends thereof are opened, and fixing the metallic narrow tubes with a binder member.

* * * * *